US006626287B1

(12) United States Patent
Watson

(10) Patent No.: US 6,626,287 B1
(45) Date of Patent: Sep. 30, 2003

(54) ANTI-TIPPING STORAGE BOX FOR EYEGLASSES AND THE LIKE

(76) Inventor: C. Joe Watson, 5108 Thomas Ave. South, Minneapolis, MN (US) 55410

( * ) Notice: Subject to any disclaimer, the term of this patent is extended or adjusted under 35 U.S.C. 154(b) by 2 days.

(21) Appl. No.: 10/131,341

(22) Filed: Apr. 24, 2002

(51) Int. Cl.[7] ..... A45C 11/04
(52) U.S. Cl. ..... 206/6; 220/260; 220/830
(58) Field of Search ..... 206/516, 564, 206/749, 752, 753; 220/827–832, 529, 531, 260, 264, 810

(56) References Cited

U.S. PATENT DOCUMENTS 1,004,474 A 9/1911 Schnorr
2,371,557 A * 3/1945 Sullivan ..... 206/6
2,809,766 A * 10/1957 Anderson ..... 206/6
4,799,604 A * 1/1989 Okojima et al. ..... 220/830
5,100,006 A 3/1992 Forrester
D433,230 S 11/2000 Ellis
6,296,142 B1 * 10/2001 Nguyen ..... 220/830

* cited by examiner

*Primary Examiner*—Luan K. Bui
(74) *Attorney, Agent, or Firm*—Patterson, Thuente, Skaar & Christensen, P.A.

(57) ABSTRACT

An anti-tipping storage box for eyeglasses has a base portion having an upper surface with compartments formed therein that are adapted to receive a pair of eyeglasses. The base portion has a predetermined overturning resisting movement. The storage box further has a cover portion hingedly connected to the base portion that may be opened and closed. At least one spring member is provided to bias the cover portion to the open position. A mechanical stop member is provided to resiliently stop the cover portion at the open position over a predetermined angular range of cover rotation and cause the cover portion to impart an overturning moment to said base portion that is resisted by the predetermined overturning resisting moment. Preferably, the predetermined overturning resisting moment of the base portion is selected so as to be at least 2 times but not more than 4 times the overturning moment.

26 Claims, 5 Drawing Sheets

SIDE

ANTI-TIPPING STORAGE BOX FOR EYEGLASSES AND THE LIKE

FIELD OF THE INVENTION

This invention relates to storage boxes for eyeglasses. More specifically, it relates to anti-tipping stationary storage boxes for eyeglasses.

BACKGROUND OF THE INVENTION

In recent years, with the general aging of the population, the need for eyeglasses to correct vision defects in people has increased. Research in vision diagnosis and treatment has also indicated that it is sometimes desirable to wear different eyeglasses based on the purpose and situation in which they are to be used. For example, it is now common that separate eyeglasses intended especially for use in viewing a computer screen are prescribed for some individuals, in addition to other pairs of eyeglasses used for other purposes such as driving or reading. Prescription sunglasses, non-prescription sunglasses for use over contact lenses and special prescriptions for use in hobbies and recreational activities all may be employed. The result has been that more persons are wearing multiple pairs of eyeglasses.

Since only one pair of eyeglasses may generally be worn at one time, a user must typically store or carry the other pairs along wherever they may be needed. Lighter weight glasses are desirable from both a comfort and a style standpoint. Due to the need to make eyeglasses lightweight, the frames of the glasses are often somewhat delicate and may be easily bent or broken. Optimal vision correction performance is not achieved if the lenses are misaligned through bending of the frames. In addition, eyeglasses can have precision optic lenses that degrade in performance if scratched. In particular, antireflective coatings and other high performance coatings tend to be soft and easily damaged through abrasion and exposure to dirt and the like. Further, when glasses are folded, the ends of temples tend to contact the backside of the prescription lenses and scratch them at the point of contact. As a result, it is desirable to protect eyeglasses in some form of box or case when they are not being worn.

The increase in the number of eyeglass pairs owned by individuals, coupled with the need to protect those glasses has resulted in an increased need for a convenient stationary protective box or case for storing multiple pairs of eyeglasses.

An early attempt at creating a case for multiple pairs of eyeglasses is disclosed in U.S. Pat. No. 1,004,474 to Schnorr. This case was designed to be portable in a shirt or jacket pocket and, as a result, was of very lightweight construction. Also, access to each pair of eyeglasses is from an opposite side of the case. If such a design were to be used for a stationary case, the result would be a case that must be picked up to access one of the pairs of eyeglasses, and a case that was easily upset and subject to tipping when rested on a surface.

A more recent design for an eyeglass case allowing access to more than one pair of glasses from the same side of the case is shown in U.S. Design Pat. No. 433,230 to Ellis. This design, however, has a number of disadvantages. First, the case is relatively deep, and eyeglasses stored in the slots would not easily be seen and distinguished without extracting them from the slots. Also, the cover is separate from the main portion of the case. Such a loose cover cannot be easily removed and replaced without lifting the case or using two hands, and can be easily lost. In addition, the case is designed to be portable and thus of lightweight construction.

Apart from closed case designs, various types of stands have been developed for stationary display and storage of eyeglasses. One example of such a stand is disclosed in U.S. Pat. No. 5,100,006 to Forrester. Such stands, however, are generally unsuitable for use outside of a retail sales environment, since they are open and may not adequately protect the glasses from dust and other harmful contaminants.

While existing devices for storing multiple pairs of eyeglasses have been developed, there remains a need for a storage box that will more effectively accommodate more than one pair of eyeglasses and that is convenient and resistant to tipping when used in a stationary position.

SUMMARY OF THE INVENTION

The present invention provides an anti-tipping storage box for eyeglasses that may rest on a table, shelf, or other surface. The storage box has a base portion having an upper surface with compartments formed therein adapted to receive a pair of eyeglasses. The base portion has a predetermined overturning resisting moment. The storage box further has a cover portion connected with a hinge arrangement to said base portion. The cover portion may be opened and closed over the upper surface of the base portion, and has an open position and a closed position. At least one spring member is provided to bias the cover portion to the open position. Further, a resilient mechanical stop member is provided to resiliently stop the cover portion at the open position over a predetermined angular range of cover rotation and cause said cover portion to impart an overturning moment to said base portion. In the invention, the predetermined overturning resisting moment of the base portion is selected so as to be at least 2 times and preferably not more than 4 times the overturning moment.

In a preferred embodiment, the storage box may be provided with a latching mechanism for securing the storage box in a closed position. The bottom surface of the storage box may be provided with a friction-generating surface to provide anti-slipping properties and to allow the case to be used on an inclined surface. A dampener mechanism may be provided to oppose the bias of the spring member, so that the cover portion opens in a smooth, controlled manner.

The particular anti-tipping properties of the storage box are uniquely advantageous in that the box is securely prevented from overturning by the predetermined weight and location of the center of gravity of the base portion that creates an overturning resisting moment. A portion of the bottom of the storage box may be covered with hook-and-loop fastener material to allow the box to be removably attached a desired surface, thus effectively contributing to the overturning resisting moment and preventing the box from sliding on the surface. In addition, the storage box of the invention has an aesthetically pleasing "heft" and conveys a sense of solidity and stability, while avoiding excessive bulkiness.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE PREFERRED EMBODIMENTS

Figure 1:
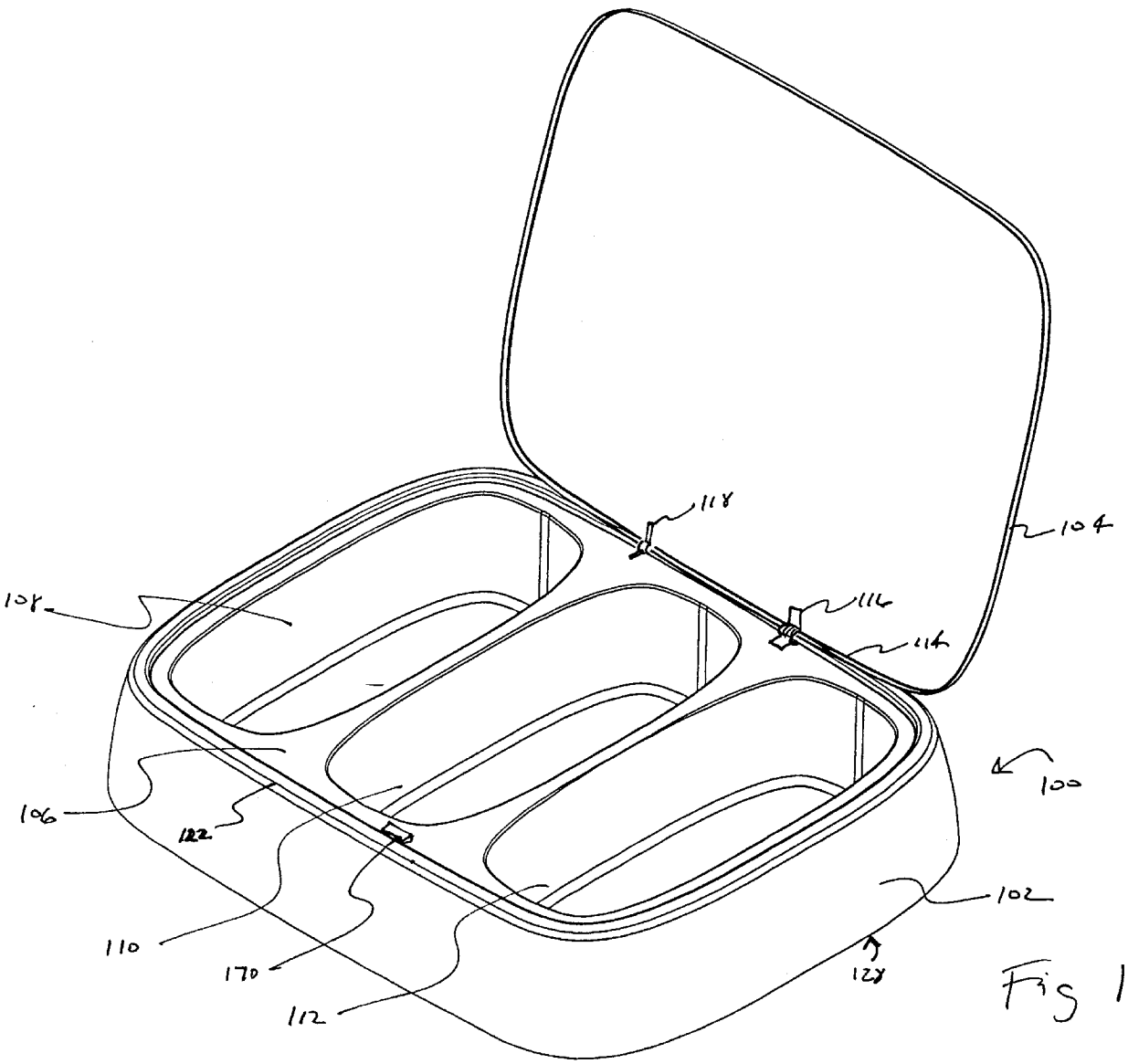
FIG. 1 is a perspective view of a preferred embodiment of the storage box of the present invention.

In FIG. 1, there is shown generally a currently most preferred embodiment of the eyeglass box 100 of the present invention. Box 100 is configured as a rigid box formed from base portion 102 and cover portion 104. Base portion 102 has compartments 108, 110 and 112 formed in upper surface 106 which are adapted for receiving a pair of eyeglasses. It will be understood that base portion 102 and upper surface 106 may be defined as a single integral unit or may be created by multiple components, such as an exterior box forming base portion 102 with an insert defining upper surface 106.

Those of skill in the art will recognize that the volume necessary for each compartment 108, 110 and 112 when adapted to receive eyeglasses is determined by the length, width and depth orientations of a folded pair of eyeglasses. For the purpose of the present invention, the length orientation of a pair of eyeglasses is the long dimension across both lenses when the eyeglasses are folded; the width orientation is the dimension perpendicular to the length orientation in a plane formed by the lenses; and the depth orientation of a pair of eyeglasses is the dimension orthogonal to the plane formed by the lenses and is the thickness of the pair of eyeglasses when folded. In addition, it will be recognized that the depth of compartments 108,. 110 and 112 may be selected so as to allow a folded pair of eyeglasses disposed within the compartment to be viewed with cover portion 104 open without removing the eyeglasses from the compartment. This feature may allow a user to quickly and easily distinguish and select different pairs of eyeglasses by their physical appearance, such as for example, frame color and shape or the edge appearance of the lenses. Compartments 108, 110 and 112 may be padded with any suitable material in order to resist scratching or abrasion of eyeglasses placed in the compartments. Base portion 102 and cover portion 104 are hinged together at hinge arrangement 114, which may be comprised of one or multiple hinge apparatus of any suitable type of metallic or plastic hinge, flexible material or scored material. One or more spring members 116 are provided to bias cover portion 104 towards the open position. One or more resilient mechanical stop members 118 are preferably provided to limit the rotational travel of cover portion 104 and to provide a resilient, controlled stop for cover portion 104 at the open position.

Base portion 102 and cover portion 104 may be made from any suitable material, with the currently preferred materials being marble, natural or faux stone, metal, or rigid plastic preferably covered with a leather or synthetic material.

Figure 2:
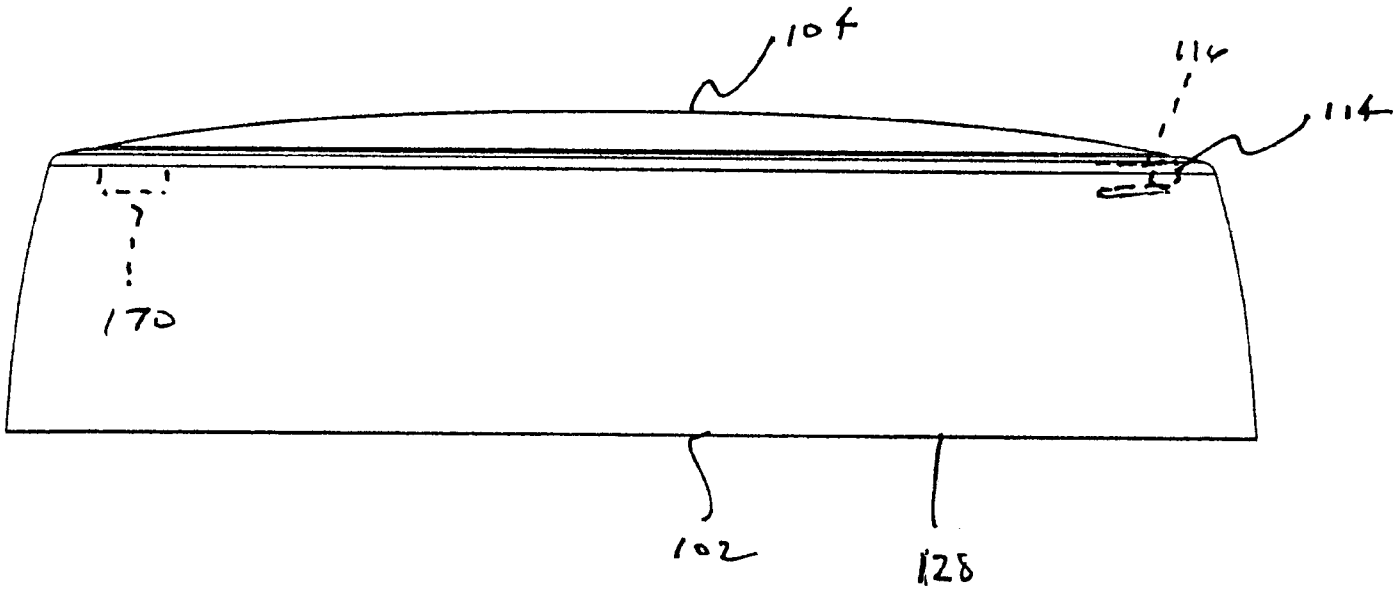
FIG. 2 is a side view of the storage box with the cover portion in the closed position.
Figure 3:
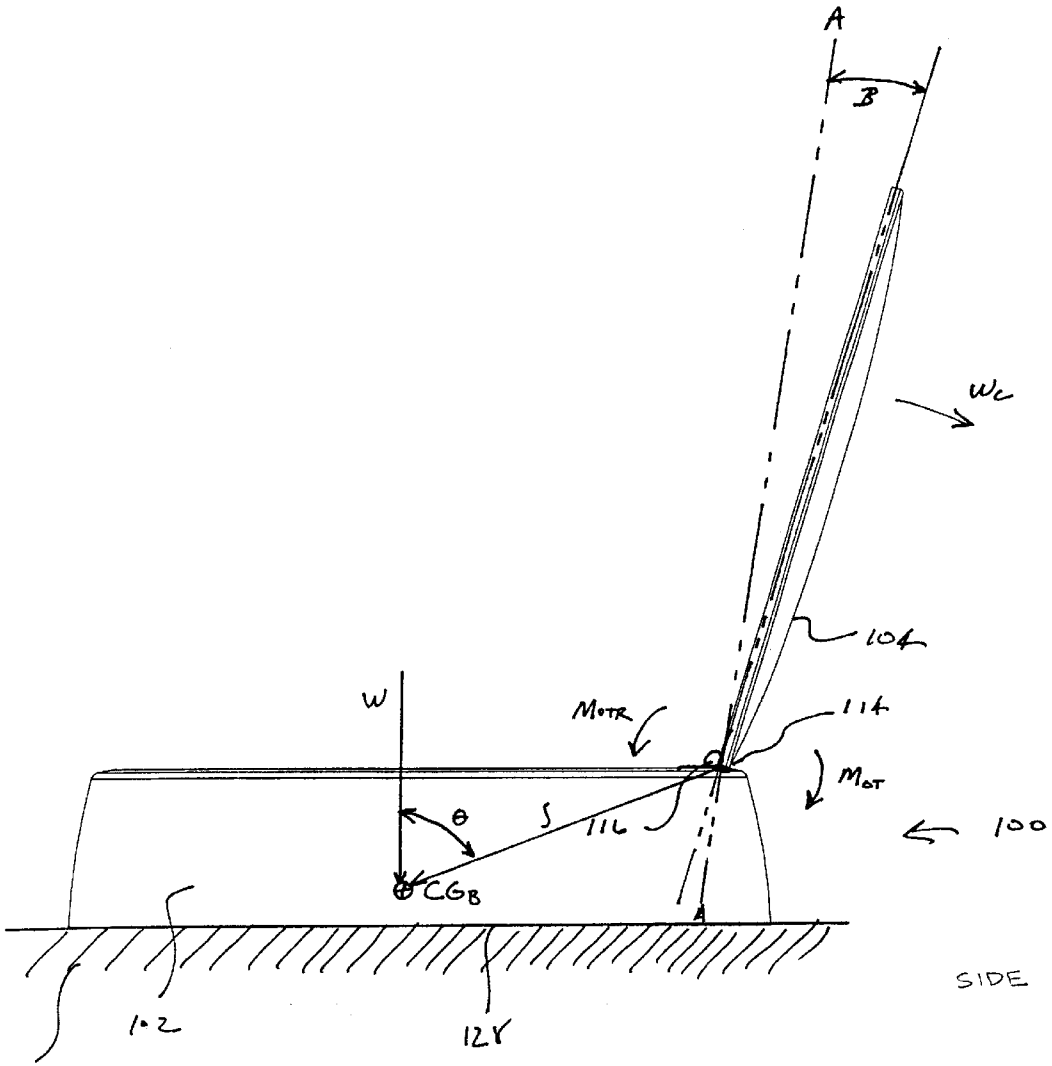
FIG. 3 is a side view of the storage box with the cover portion in the open position.

The unique anti-tipping features of the box of the present invention may be understood by reference to FIGS. 2 and 3. Initially, cover portion 104 is held in the closed position by latch 170 as shown in FIG. 2. Spring 116 is compressed and exerts a biasing force urging cover portion 104 upward. When latch 170 is released, cover portion 104 swings upward, urged by spring 116, and attains angular velocity $\omega_c$, as shown in FIG. 3. The magnitude of angular velocity $\omega_c$ may be calculated and predetermined through selection of the rate of spring 116, in light of the mass of cover portion 104. Generally, it is preferred that angular velocity $\omega_c$ be no more than 6 radians/second to limit the forces involved in stopping the rotation of cover portion 104 and to provide smooth opening action for cover portion 104 free from any unattractive "snapping" action. When cover portion 104 reaches position A—A, resilient mechanical stop member 118 begins to exert a biasing force, decelerating cover portion 104. Mechanical stop member 118 may be a spring or a solid member formed from a suitable resilient material such as rubber. The rate of mechanical stop member 118 is preferably selected so that the rotation of cover portion 104 is stopped over a predetermined rotational range, represented by angle $\beta$. It is currently preferred that angle $\beta$ be at least 0.01 radian to limit the deceleration forces involved, but not more than 0.03 radians so that cover portion 104 has the appearance of being firmly and crisply stopped. As cover portion 104 is decelerated by resilient mechanical stop member 118, the momentum of cover portion 104 causes an overturning moment $M_{otr}$ to be transmitted to base portion 102, urging rotation about hinge arrangement 114. Those of skill in the art will appreciate that the magnitude of overturning moment $M_{ot}$ may be determined by the formula:

$$M_{ot} = I_c\left(\frac{\Delta\omega_c}{\Delta t}\right)$$

where $I_c$ is the mass moment of inertia of cover portion 104, $\Delta\omega_c$ is the change in angular velocity of cover portion 104 and $\Delta t$ is the time over which cover portion 104 is decelerated. Base portion 102 will inherently have an overturning resisting moment $M_{otr}$, the magnitude of which may be determined by the relation:

$$M_{otr}=W_b(l \sin \theta)$$

where $W_b$ is the weight of base portion 102, l is the distance from hinge 114 to the center of gravity $CG_b$ of base portion 102 and $\theta$ is the angle between the line along which distance l is measured and the direction of weight $W_b$.

The unique anti-tipping characteristics of eyeglass storage box 100 are achieved by selecting weight $W_b$ and distance l so that $M_{otr}$ exceeds $M_{ot}$ by at least a factor of 2 when the storage box 100 is located on a generally horizontal surface. Eyeglass storage box 100 is thus provided with adequate resistance to tipping resulting from the momentum of cover portion 104 during opening, while also having an attractive feeling of "heft" and solidity. It is currently preferred that $M_{otr}$ not exceed $M_{ot}$ by more than a factor of 4 in order to avoid excessive weight and bulkiness for the device.

Figure 4:
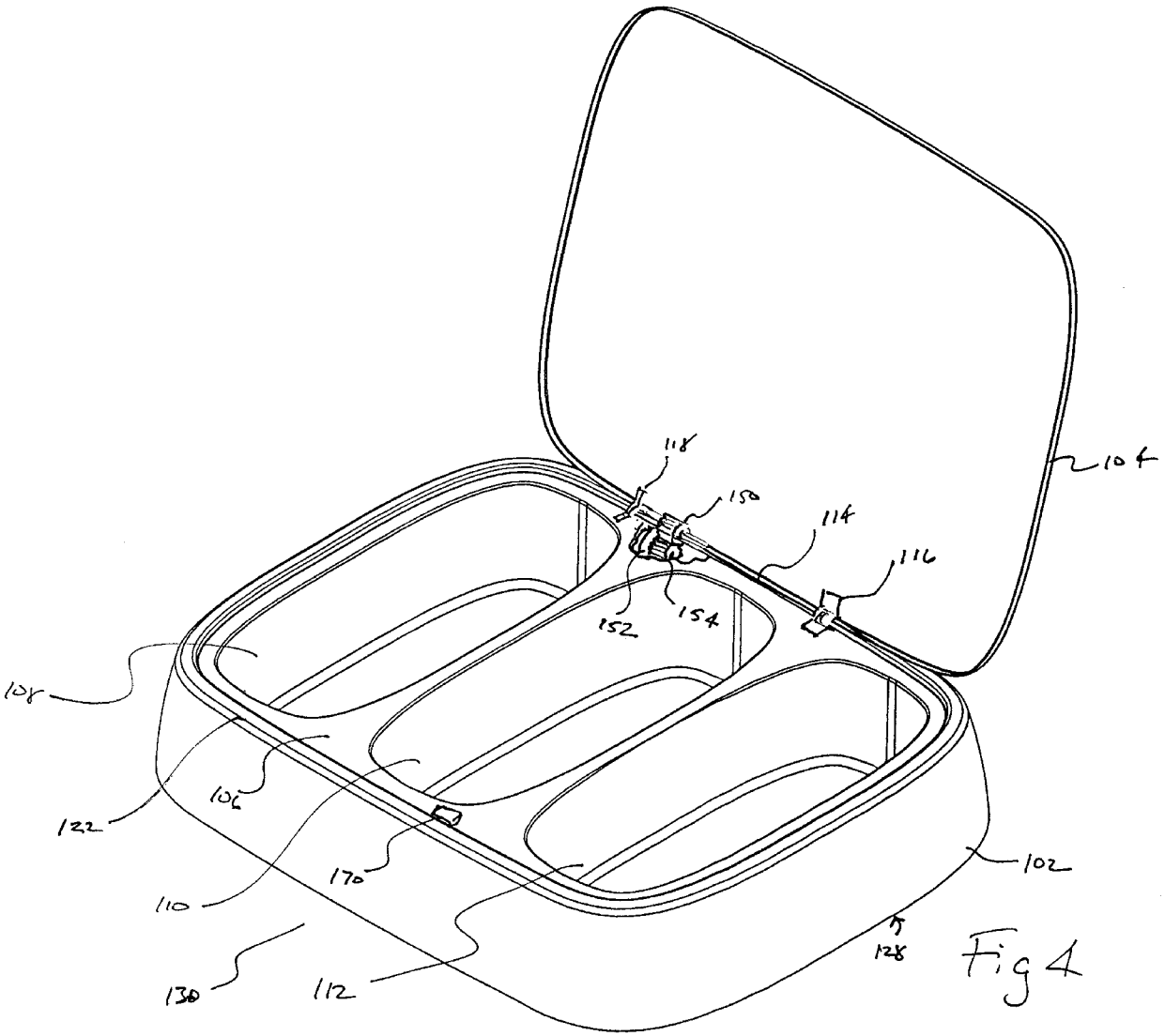
FIG. 4 is a perspective view of an alternative embodiment of the present invention.

In a preferred embodiment shown in FIG. 4, pinion 150 is fixed to the portion of hinge arrangement 114 that is rotationally fixed with respect to cover portion 104. Dampener mechanism 152 is fixed to base portion 102, and has gear 154 enmeshed with pinion 150. In operation, when spring 116 urges cover portion 104 toward the open position for eyeglass storage box 100, dampener mechanism 152 acts to retard the relative motion of cover portion 104 and base portion 102, thereby providing a smoother opening motion for eyeglass storage box 100. Those of skill in the art will recognize that dampener mechanism 152 opposes to some degree the force exerted by spring 116 and as a result will affect the angular velocity $\omega_c$ achieved by cover portion 104. The dampening rate of dampener mechanism 152 may be selected accordingly so that cover portion 104 achieves the desired angular velocity. Although a pinion arrangement is described, dampener mechanism 152 may be any standard miniature dampener mechanism or pinion, or camming operation or the like, such as for example, those manufactured by NIFCO, Inc. of Japan.

Case. 100 is preferably provided with a latch so that the case may be securely fastened in a closed position. The latch may be of any type such as mechanical, hook and latch, or the like and may be located in any effective location. Currently, it is most preferred that the latch be magnetic and of the push-latch type.

Referring again to FIG. 4, magnetic latch 170 is of the push-latch type and is provided along front edge 122 of base portion 102. Those of skill in the art will recognize that a particularly advantageous mode of operation for storage box 100 may be achieved when storage box 100 is closed and placed with bottom 128 resting on a flat surface 130. In that position, cover portion 104 may be lightly pressed downward toward base portion 102 releasing magnetic latch 170. Spring 116 urges cover portion 104 upward, opening storage box 100. Dampener mechanism 152 provides a retarding force, resisting the bias of the spring, and causing storage box 100 to smoothly open to the stable open position as shown.

Storage box 100 is preferably made resistant to sliding on a surface, and thus usable on an inclined surface by adding a friction generating material to bottom surface 128. Although any suitable friction material can be used, the currently preferred material is synthetic rubber.

Storage box 100 may be made removably adherable to any desired surface by covering a portion of bottom surface 128 with hook-and-loop material and by affixing a corresponding piece of hook-and-loop material to the desired surface on which storage box 100 will be placed. Such an embodiment of storage box 100 may be particularly advantageous for use in a vehicle, where it may be desirable to secure the box to prevent movement when the vehicle is moving while still allowing the box to be portable. Those of skill in the art will recognize that the holding force of the hook-and loop fastening will be directed counter to overturning moment $M_{ot}$ and will effectively add to overturning resisting moment $M_{otr}$. Thus, if such a hook-and-loop fastening is used, the magnitude of weight $W_b$ and/or distance l may be reduced by an amount proportionate to the coverage amount of holding force provided by the hook-and-loop fastening arrangement. Although less preferable, other releasable surface securing arrangements such as double-sided tape or the like may also be used in this embodiment.

Figure 5:
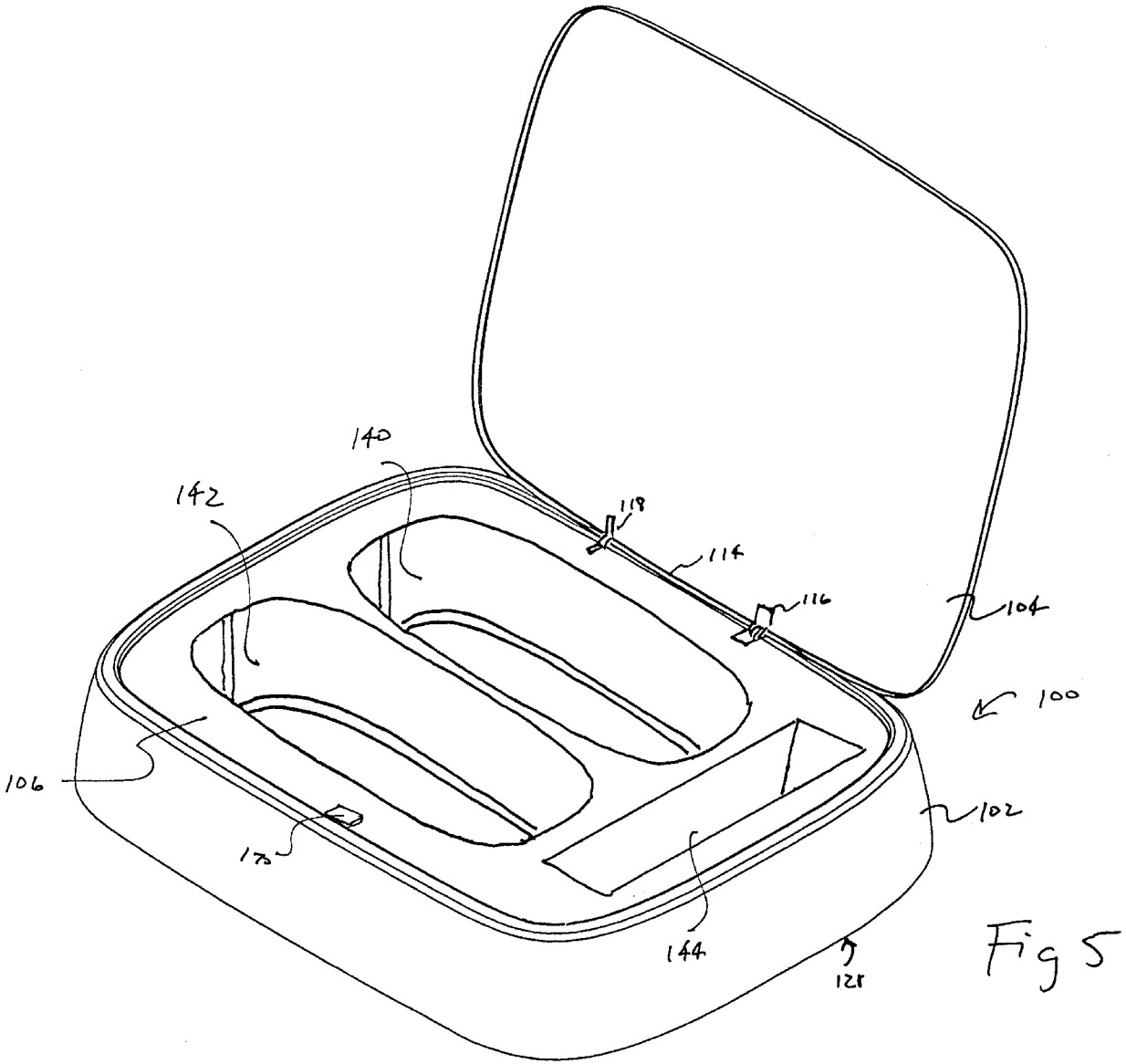
FIG. 5 is a perspective view of another alternative embodiment of the present invention.

The anti-tipping storage box of the present invention may be made in a variety of alternative configurations and sizes, and used for a variety of purposes while remaining within the scope of the invention. An example of such an alternative embodiment of the invention is shown in FIG. 5. Transversely oriented compartments 140 and 142 for eyeglasses are provided. Another compartment 144 is also provided, which may be used for vision care supplies such as specialized cleaning cloths for eyeglasses, or for other small items.

Although the description above contains many specificities, these should not be construed as limiting the scope of the invention but as merely providing illustrations of some of the presently preferred embodiments of the invention. Thus, the scope of the invention should be determined by the appended claims and their legal equivalents, rather than by the examples given.

What is claimed:

1. A storage box for eyeglasses and the like that may rest on a table, shelf, or other surface, comprising:

a base portion having an upper surface, the upper surface having a plurality of compartments formed therein, each of the plurality of compartments being adapted to receive a pair of eyeglasses, said base portion having a predetermined overturning resisting moment;

a cover portion hingedly connected to said base portion and disposable over at least a part of the upper surface of said base portion, said cover portion having an open position and a closed position;

at least one spring member operably arranged between said base portion and said cover portion to bias said cover portion to the open position; and a mechanical stop member disposed so as to stop said cover-portion at the open position, said mechanical stop member being adapted to cause said cover portion to impart an overturning moment to said base portion, the predetermined overturning resisting moment of said base portion being selected so as to be at least 2 times the overturning moment.

2. The storage box of claim 1, wherein said mechanical stop member is resilient and is disposed so as to resiliently stop said cover portion at the open position over a predetermined angular range of cover rotation.

3. The storage box of claim 1, wherein the predetermined overturning resisting moment of said base portion is selected so as to be not more than 4 times the overturning moment.

4. The storage box of claim 1, wherein said storage box for eyeglasses has a friction generating bottom surface.

5. The storage box of claim 1, further comprising a dampener mechanism disposed so as provide a retarding force opposing the bias of said spring member.

6. The storage box of claim 1, further comprising a latch mechanism operably arranged between said base portion and said cover portion to releasably secure said cover portion to said base portion.

7. The storage box of claim 6, wherein said latch mechanism comprises a magnetic push-latch.

8. The storage box of claim 1, wherein said storage box has a bottom surface, at least a portion of said bottom surface being covered with hook-and-loop material.

9. A storage box for eyeglasses that may rest on a table, shelf, or other surface, comprising:

a base portion having an upper surface, the upper surface having a plurality of compartments formed therein, each of the plurality of compartments being adapted to receive a pair of eyeglasses, said base portion also having a bottom surface;

a cover portion hingedly connected to said base portion and disposable over at least a part of the upper surface of said base portion, said cover portion having an open position and a closed position;

at least one spring member operably arranged between said base portion and said cover portion to bias said cover portion to the open position;

a mechanical stop member disposed so as to stop said cover portion at the open position; and means for preventing tipping of said storage box.

10. The storage box for eyeglasses of claim 9, wherein said means for preventing tipping of said storage box comprises said cover portion having a predetermined overturning moment, said base portion having a predetermined overturning resisting moment, the predetermined overturning resisting moment being at least 2 times the predetermined overturning moment.

11. The storage box of claim 10, wherein the predetermined overturning resisting moment is selected so as to be not more than 4 times the predetermined overturning moment.

12. The storage box of claim 9, wherein said mechanical stop member is resilient and is disposed so as to resiliently stop said cover portion at the open position over a predetermined angular range of cover rotation.

13. The storage box of claim 9, further comprising means for causing friction between the bottom surface of said base portion and a flat surface.

14. The storage box of claim 9, further comprising a dampener means for providing a retarding force opposing the bias of said spring member.

15. The storage box of claim 9, further comprising a latching means for releasably securing said cover portion to said base portion.

16. The case of claim 15, wherein said latching means comprises a magnetic push-latch.

17. The storage box of claim 9, wherein said storage box has a bottom surface, at least a portion of said bottom surface being covered with hook-and-loop material.

18. A storage box, comprising:

a base portion having an upper surface, the upper surface having at least one compartment formed therein, said base portion having a predetermined overturning resisting moment;

a cover portion hingedly connected to said base portion and disposable over at least a part of the upper surface of said base portion, said cover portion having an open position and a closed position;

at least one spring member operably arranged between said base portion and said cover portion to bias said cover portion to the open position; and a resilient mechanical stop member disposed so as to resiliently stop said cover portion at the open position over a predetermined angular range of cover rotation and cause said cover portion to impart an overturning moment to said base portion, the predetermined overturning resisting moment of said base portion being selected so as to be at least 2 times the overturning moment.

19. The case of claim 18, wherein the predetermined overturning resisting moment of said base portion is selected so as to be not more than 4 times the overturning moment.

20. The case of claim 18, wherein said at least one compartment is adapted to receive at least one pair of eyeglasses.

21. The case of claim 18, wherein said storage box has a friction generating bottom surface.

22. The case of claim 18, further comprising a dampener mechanism disposed so as provide a retarding force opposing the bias of said spring member.

23. The case of claim 18, further comprising a latch mechanism operably arranged between said base portion and said cover portion to releasably secure said cover portion to said base portion.

24. The case of claim 18, wherein said latch mechanism comprises a magnetic push latch.

25. The storage box of claim 18, wherein said storage box has a bottom surface, at least a portion of said bottom surface being covered with hook-and-loop material.

26. A method for preventing tipping of a storage box comprising the steps of:

providing a storage box having a base portion with an upper surface, the upper surface having at least one compartment formed therein, a cover portion hingedly connected to the base portion and disposable over at least a part of the upper surface of the base portion, the cover portion having an open position and a closed position, at least one spring member operably arranged between the base portion and the cover portion to bias the cover portion to the open position, a resilient mechanical stop member disposed so as to resiliently stop the cover portion at the open position over a predetermined angular range of cover rotation and cause the cover portion to impart an overturning moment to the base portion, the predetermined overturning resisting moment of the base portion being selected so as to be at least 2 times but not more than 4 times the overturning moment;

placing said box on a flat surface; and opening said cover portion from said base portion.

* * * * *